United States Patent [19]

Sasaki et al.

[11] 4,064,688

[45] Dec. 27, 1977

[54] TOUCH SENSITIVE ELECTRODE ASSEMBLY FOR SOLID STATE WRISTWATCHES

[75] Inventors: Takehiko Sasaki, Yamatokoriyama; Tsutomu Nakamura, Akashi, both of Japan

[73] Assignee: Sharp Kabushiki Kaisha, Osaka, Japan

[21] Appl. No.: 664,282

[22] Filed: Mar. 5, 1976

[30] Foreign Application Priority Data

| | | |
|---|---|---|
| Mar. 6, 1975 | Japan | 50-27861 |
| Mar. 6, 1975 | Japan | 50-31016[U] |

[51] Int. Cl.[2] ..... G04B 19/30; H01H 35/00

[52] U.S. Cl. ..... 58/50 R; 58/23 R; 200/52 R; 200/159 R; 200/DIG. 1; 200/DIG. 2

[58] Field of Search ..... 58/23 R, 50 R, 90 B, 58/88 R, 88; 200/159 R, 52 R, DIG. 1, DIG. 2; 340/365 C; 357/2, 11; 65/155, DIG. 15; 106/47

[56] References Cited

U.S. PATENT DOCUMENTS

| | | | |
|---|---|---|---|
| 2,883,291 | 4/1959 | Fraser | 65/DIG. 15 |
| 3,737,670 | 6/1973 | Larson | 200/DIG. 2 |
| 3,757,322 | 9/1973 | Barkan | 340/365 C |
| 3,823,550 | 7/1974 | Bergey | 58/50 R |
| 3,911,664 | 10/1975 | Haber | 58/23 R |
| 3,920,461 | 11/1975 | Asahara | 357/2 UX |
| 3,983,690 | 10/1976 | McClintock | 58/50 R |

*Primary Examiner*—James R. Scott

*Attorney, Agent, or Firm*—Birch, Stewart, Kolasch & Birch

[57] ABSTRACT

A front glass sheet having a viewing window and conventionally received within a casing of a solid state wristwatch, is made of electrically conductive glass material which manifests conductivity per se, for serving as one of the principal components of a touch sensitive electrode assembly. In one preferred form, the front glass sheet is made of amorphous (glass) semiconductor such as chalcogenide glass of resistivity less than several hundred KΩ cm.

13 Claims, 2 Drawing Figures

TOUCH SENSITIVE ELECTRODE ASSEMBLY FOR SOLID STATE WRISTWATCHES

BACKGROUND OF THE INVENTION

The present invention relates to a solid state wristwatch having a touch sensitive switch, and more particularly to an improved electrode assembly of the touch sensitive switch.

Recently, attention has been directed to the development of a touch sensitive, contactless electronic switch, that is, the substitute for the prior art mechanical stem. One approach has been suggested where the touch sensitive electrode is set up of a transparent film such as tin oxide and indium oxide deposited on the front surface of a front glass sheet. This required complicated fabrication processes and thus was not suited for large-scale production.

Accordingly, it is an object of the present invention to provide an improved touch sensitive electrode structure which can facilitate the fabrication steps and thus be suited for large-scale production.

Other objects of the present invention will be readily appreciated as the same becomes better understood by reference to the following detailed description which considered in conjunction with the accompanying drawings in which like reference numerals designate like parts throughout the figures, and wherein:

DETAILED DESCRIPTION OF THE PREFERRED EMBODIMENTS

Figure 1:
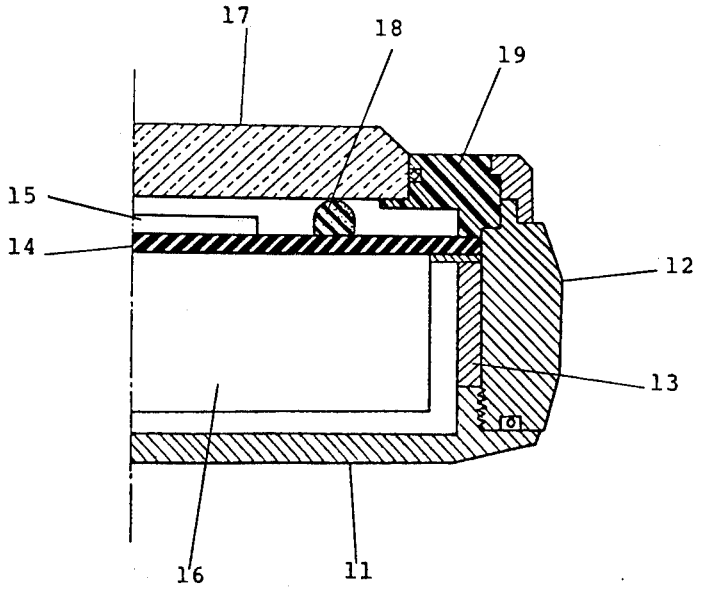
FIG. 1 is a cross sectional view of a solid state wristwatch constructed in accordance with the present invention.

Referring now to FIG. 1, there is illustrated a solid state wristwatch constructed in accordance with the present invention with a wristwatch bracelet removed. As also viewed from FIG. 2, a rear cover 11 is conventionally kept in physical and electrical contact with the body of the user when the solid state wristwatch is wound around the user's wrist. Generally, the rear cover is made of electrically conductive material such as metal and, therefore, serves as one electrode of a touch sensitive electrode assembly. A casing 12 and a frame 13 also are made of electrically conductive material and kept in physical and electrical contact with the rear cover 11. A printed circuit board 14 of which the substrate may be ceramics or resin, carries at the upper surface thereof a digital display 15 constituted of light emitting diode array or liquid crystal module and at the lower surface thereof an integrated circuit 16 together with interconnections interposed therebetween. Electrical connection is provided between the rear cover 11 and the integrated circuit 16 through the casing 12, the frame 13 and electrically conductive leaves (not shown) deposited on the circuit board 14.

A front glass sheet 17 deposited above the digital display 15, is made of electrically conductive glass material which manifests conductivity per se, for example, amorphous (glass) semiconductor material. By way of example, chalcogenide glass consisting of selenium (Se), tellurium (Te) and sulfur (S) is well known as amorphous (glass) semiconductor material pervious to visible light.

Electrical connection between the front glass sheet 17 and the integrated circuit 16 is accomplished via an elastic connector 18 of electrically conductive rubber and electrically conductive leaves (not shown) on the printed circuit board 14. A ring-shaped insulator 19 of plastics provides electrical isolation between the casing 12 and the front glass sheet 17. The glass sheet 17 is received within the casing 12 with aid of the insulator 19.

Figure 2:
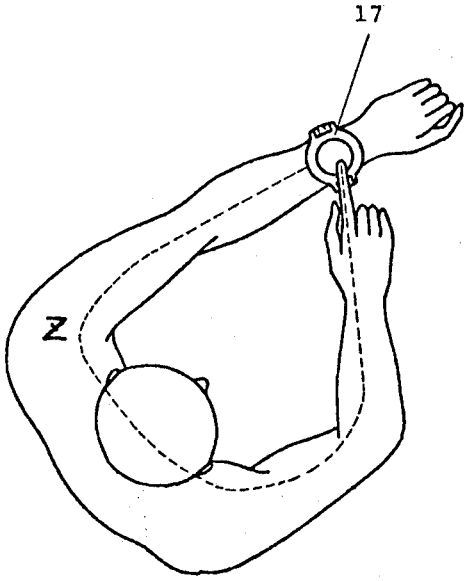
FIG. 2 is a plan view of the solid state wristwatch in operational state.

With such an arrangement, as illustrated in FIG. 2, when the user contacts at least a portion of the front glass sheet 17 by his hand carrying no wristwatch, a circuit path will be established as depicted by the dotted line so that the resistance Z of the user's body is connected operatively between the front glass sheet 17 and the rear cover 11. This results in that the resistance Z is connected with the integrated circuit 16 within the wristwatch to render the touch sensitive switch operative for the purpose of altering operation states of the wristwatch. If the user's hand is released, the current path will be opened to thereby place the touch sensitive switch into the non-operative state.

Detailed description of a touch sensitive switch utilizing circuit arrangement is fully illustrated and described in co-pending application Ser. No. 575,731 entitled SWITCHING MECHANISM FOR ELECTRONIC WRISTWATCH, filed on May 8, 1975, by Takehiko Sasaki and Hidetoshi Maeda, the disclosure of which is incorporated herein by reference.

Since the front glass sheet 17 is made of electrically conductive glass material which manifests conductivity per se as discussed above, the touch sensitive electrode can be made on a large-scale production base without complexity of fabrication as experienced during the conventional touch switch fabrication. Vacuum deposition is not required. In case of chalcogenide glass pervious to visible light, proper selection of glass material pervious to red light for GaAsP LED (light emitting diode) display wristwatches may enable the front glass sheet 17 to serve also as color filter.

The resistivity required for the touch sensitive switch should be less than several hundred KΩ cm and the amorphous semiconductor material set forth above can fully satisfy that requirement. Commercially available chalcogenide glass is "Ovonic (trademark)" manufactured by Energy Convention Devices Inc., where the resistivity is selectable within a range from several KΩ cm to several hundred KΩ cm.

In the meantime, there is a requirement for attaining the normal operation state of the touch sensitive switch that insulating resistance higher than 50 MΩ is intervened between the front glass sheet 17 and the rear cover 11. The requirement may be fulfilled by constructing the insulating member 19 of plastics such as Teflon and nylon. In the event that water drops are attached to the upper surface of the front glass sheet 17, shunting between the front glass sheet 17 and the casing 12 will be prevented because of sufficient thickness of the insulating member 19. In the case of Teflon insulators, the water-repellent nature is expected.

While only certain embodiments of the present invention have been described, it will be apparent to those skilled in the art that various changes and modifications may be made therein without departing from the spirit and scope of the invention as claimed.

What is claimed is:

1. A touch sensitive switch assembly for a solid state wristwatch comprising:

an enclosure of said solid state wristwatch for engagement with the wrist of a wearer, which is made of electrically conductive material for serving as one electrode of said touch sensitive switch;

a front glass sheet received within said enclosure and having a viewing window; said front glass sheet being made of electrically conductive glass material which manifests electrical conductivity per se, for serving as a selectively touchable electrode of said touch sensitive switch; and an insulating member supporting said front glass sheet in said enclosure for providing electrical isolation therebetween.

2. A touch sensitive switch assembly as defined in claim 1 wherein the electrically conductive glass material is of resistivity less than several hundred KΩ cm.

3. A touch sensitive switch assembly as defined in claim 1 wherein the electrically conductive glass material is an amorphous semiconductor.

4. A touch sensitive switch assembly as defined in claim 3 wherein the amorphous semiconductor is chalcogenide glass.

5. A touch sensitive switch assembly as defined in claim 1 wherein the insulating member is made of plastics with the aid of which the front glass sheet is received within the enclosure.

6. A touch sensitive switch assembly as defined in claim 1 wherein the front glass sheet is led via an elastic connector to an integrated circuit accommodated within the enclosure.

7. A touch sensitive switch assembly as defined in claim 1 wherein a display is provided beneath the viewing window and accommodated within the enclosure and the front glass sheet is pervious to light emission emerging from the display.

8. The invention defined in claim 1, wherein said insulating member is so shaped and so proportioned as to provide at least a 50MΩ resistance path between said front glass sheet and said enclosure.

9. The invention defined in claim 1, wherein said insulating member is of sufficient thickness to prevent an electrical path from developing between said front glass sheet and said enclosure in the event of water drops attaching to said insulating member.

10. A touch sensitive switch assembly for a solid state wristwatch comprising:

an enclosure of said solid state wristwatch for engagement with the wrist of a wearer, said enclosure comprising electrically conductive material for serving as one electrode of said touch sensitive switch;

a front glass sheet received within said enclosure and having a viewing window therein;

an insulating member supporting said front glass sheet in said enclosure for providing electrical isolation therebetween;

an integrated circuit means accommodated within said enclosure adjacent said front glass sheet; and an elastic connecting means conductively coupling said integrated circuit with said front glass sheet;

said front glass sheet comprising electrically conductive glass material having a resistivity less than several hundred KΩ cm and consisting of chalcogenide glass.

11. The invention defined in claim 10, wherein said insulating member is of sufficient thickness to prevent an electrical path from developing between said front glass sheet and said enclosure in the event of water drops attaching to said insulating member.

12. A touch sensitive switch assembly for a solid state wristwatch comprising:

an enclosure of said solid state wristwatch for engagement with the wrist of a wearer, said enclosure comprising electrically conductive material for serving as one electrode of said touch sensitive switch;

a front glass sheet received within said enclosure and having a viewing window therein;

an insulating member supporting said front glass sheet in said enclosure for providing electrical isolation therebetween; and display means provided beneath the viewing window and accomodated within said enclosure;

said front glass sheet being pervious to light emission emerging from said light emitting display;

said front glass sheet comprising electrically conductive glass material having a resistivity less than several hundred KΩcm.

13. The invention defined in claim 12, wherein said insulating member is of sufficient thickness to prevent an electrical path from developing between said front glass sheet and said enclosure in the event of water drops attaching to said insulating member.

* * * * *